United States Patent [19]

Lisec

[11] Patent Number: 4,902,213

[45] Date of Patent: Feb. 20, 1990

[54] APPARATUS FOR CLOSING OPENINGS IN SPACER STRIPS

[76] Inventor: Peter Lisec, Bahnhofstrasse 34, A-3363 Amstetten-Hausmening, Austria

[21] Appl. No.: 244,855

[22] Filed: Sep. 15, 1988

[30] Foreign Application Priority Data

Sep. 16, 1987 [AT] Austria ..... 2341/87

[51] Int. Cl.[4] ..... B29C 47/02

[52] U.S. Cl. ..... 425/113; 156/107; 156/244.22

[58] Field of Search ..... 425/13, 62, 104, 113, 425/461, DIG. 23; 156/99, 107, 109, 244.11, 244.22

[56] References Cited

U.S. PATENT DOCUMENTS

| | | | |
|---|---|---|---|
| 3,205,056 | 9/1965 | Roetter et al. | 156/107 X |
| 4,145,237 | 3/1979 | Mercier et al. | 156/244.22 X |
| 4,434,024 | 2/1984 | Lisec | 156/99 X |
| 4,495,023 | 1/1985 | Lisec | 156/109 X |
| 4,519,962 | 5/1985 | Schlienkamp | 156/109 X |
| 4,559,001 | 12/1985 | Wiedenhofer et al. | 156/109 X |
| 4,561,929 | 12/1985 | Lenhardt | 156/99 X |
| 4,617,073 | 10/1986 | Scott | 156/107 |
| 4,708,762 | 11/1987 | Lenhardt | 156/109 X |
| 4,714,425 | 12/1987 | Lenhardt | 425/461 |

FOREIGN PATENT DOCUMENTS

| | | |
|---|---|---|
| 2834902 | 2/1980 | Fed. Rep. of Germany . |
| 2816437 | 4/1980 | Fed. Rep. of Germany . |
| 2846785 | 7/1984 | Fed. Rep. of Germany . |
| 8701101 | 4/1987 | Fed. Rep. of Germany . |
| 3637561 | 5/1987 | Fed. Rep. of Germany . |

*Primary Examiner*—Richard L. Chiesa
*Attorney, Agent, or Firm*—Young & Thompson

[57] ABSTRACT

An apparatus for closing openings in prefabricated, flexible spacer strips arranged between the glass sheets of insulating glass elements (5) comprises a nozzle (11) for the dispensing of sealing compound. The nozzle (11) has an extension (21) introducible into the opening to be sealed, this extension being gradually pulled out of the opening again during introduction of the sealing compound. For this purpose, the nozzle (11) is mounted to be movable at least in the direction of its nozzle orifice (arrow 19). The nozzle (11) is mounted, for example, on a holder (13, 40, 16) to the frame of the apparatus to be pivotable about an essentially perpendicular axis (17). The holder (13) of the nozzle (11) can be shifted forwards and backwards (arrow 15) transversely to the plane of the support for the insulating glass elements (5), in order to be able to vacate the conveying path of the insulating glass elements.

8 Claims, 2 Drawing Sheets

FIG.1
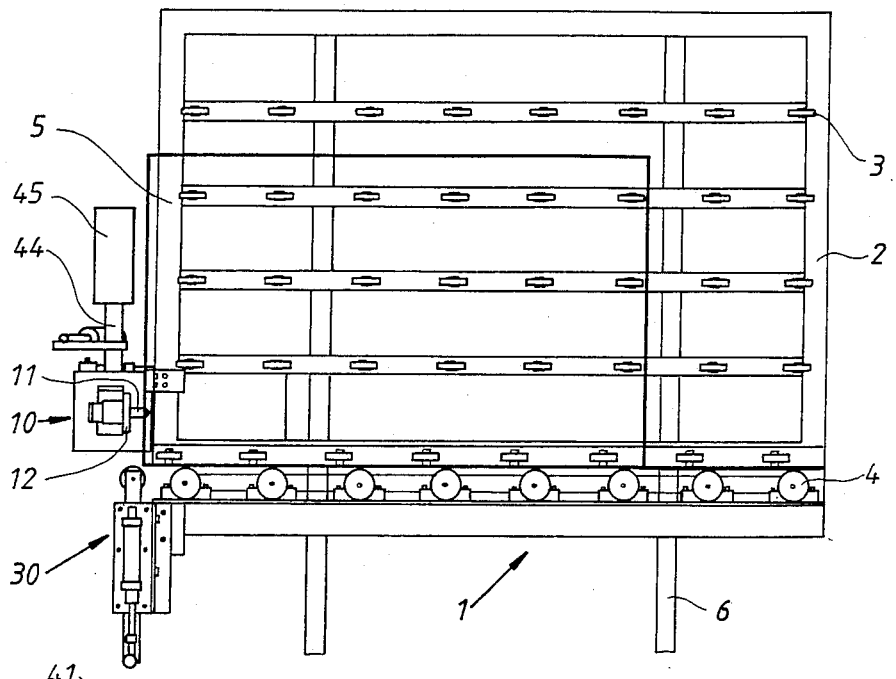
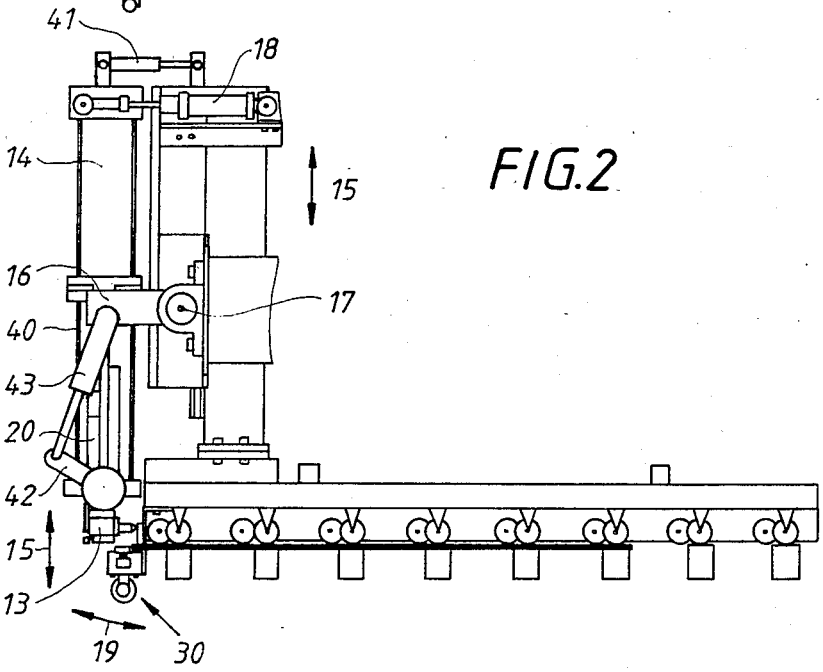
FIG.2

APPARATUS FOR CLOSING OPENINGS IN SPACER STRIPS

FIELD OF THE INVENTION

The invention relates to an apparatus for closing openings in spacer strips arranged between the glass sheets of insulating glass elements, especially gaps between the ends of prefabricated, flexible spacer strips, with a nozzle for the dispensing of sealing compound, this nozzle being movably mounted in the frame of the apparatus.

1. Background of the Invention

When using prefabricated, endless flexible spacer strips, which ensure the distance between the glass sheets of insulating glass elements, the problem arises of tightly joining the free ends of the spacer strip which latter is applied in one piece along the rims of the glass sheet.

2. The Prior Art

In this connection, U.S. Pat. No. 4,561,929 suggests to seal the gap between the ends of the spacer strip, after the press-molding of insulating glass, the gap by fusing the ends of the spacer strip with the aid of an angled, heatable appliance.

Another proposal is found in German Utility Model GM 87 01 101 wherein it is suggested to join the two ends of the spacer strip under pressure simultaneously with the shaping of a corner in the joint region of the spacer strip. Utility Model GM 87 01 101 also contains the suggestion of sealing apertures in prefabricated, flexible spacer strips (swiggle strips) by introducing a plug of butyl rubber. GM 87 01 101 does not contain any further details as to how this is to be accomplished.

A gripper with heatable jaws for joining the ends of a spacer strips applied to a glass sheet has also been disclosed in DOS 3,637,561.

OBJECT OF THE INVENTION

The invention has as its object providing an apparatus of the type discussed above, by means of which openings in prefabricated spacer strips can be securely and tightly sealed, for example the gap between the ends of spacer strips arranged between the glass sheets of insulating glass elements.

BRIEF SUMMARY OF THE INVENTION

This has been accomplished according to this invention by providing that the nozzle exhibits an extension, that a drive means is provided by means of which the nozzle can be introduced, in the direction of its nozzle aperture (arrow),into the opening to be sealed, especially into the gap, and can again be pulled out of this opening while dispensing sealing compound into the opening. Since the nozzle has an extension introducible into the opening to be sealed, and the nozzle is movable in the direction of its nozzle aperture, the nozzle can be pulled out of the opening to be closed during the step of feeding sealing compound, so that it is ensured that the opening in the spacer strip is completely filled out by sealing compound over its entire depth. In this way, an absolutely tight seal of the opening closed by means of the apparatus of this invention is ensured.

Another advantage of the apparatus according to this invention resides in that it can be readily combined together with devices for the press-molding of insulating glass and/or devices for supplying insulating glass elements with a filler gas.

The movability of the nozzle in the direction of its nozzle orifice can be attained in an especially simple way by mounting the nozzle, in an apparatus having a setup roller track for insulating glass elements and a lateral support for these elements, at a holder at the frame of the apparatus to be pivotable about an essentially perpendicular axis.

In order to keep the nozzle from interfering during the feeding and discharging of insulating glass elements, the provision can be made that the holder of the nozzle can be shifted forwards and backwards transversely to the plane of the support for the insulating glass elements. In this way, the nozzle can be moved out of the conveying plane during the feeding and carrying away of insulating glass elements.

In one embodiment of the apparatus of this invention, a freely rotatable roller is provided which can be raised from a position hidden underneath the roller track into a position wherein it is lifted above this track. This freely rotatable roller can serve as a stop for positioning the insulating glass element with respect to the nozzle when the roller has been raised into a position lifted above the setup roller track.

BRIEF DESCRIPTION OF THE DRAWING

Additional details and features of the invention can be seen from the dependent claims and the following description of the embodiment illustrated in the drawings wherein:

FIG. 1 shows an apparatus with a nozzle in a plan view from the front,

FIG. 2 is a top view of FIG. 1,

DETAILED DESCRIPTION OF THE INVENTION

Figure 3:
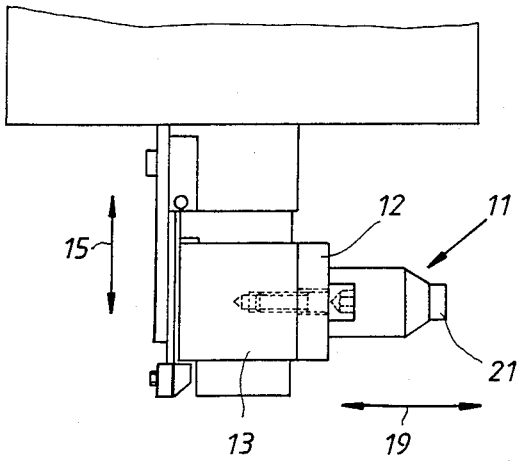
FIG. 3 shows the nozzle on an enlarged scale.
Figure 4:
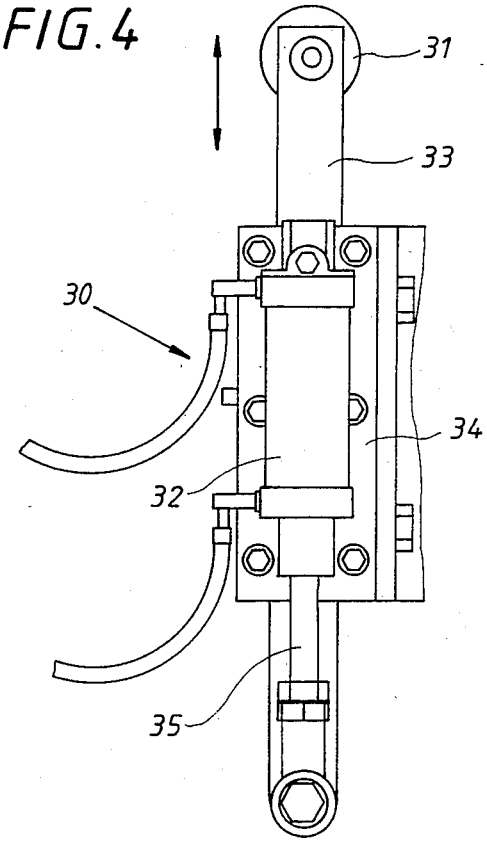
FIG. 4 shows a liftable, freely rotatable roller provided in the apparatus.

In the embodiment illustrated in the figures, the apparatus of this invention is provided in a section 1 of an arrangement for the production of insulating glass elements, this section exhibiting a lateral support 2 for insulating glass elements 5. The lateral support, in the illustrated embodiment, is a wall studded with rollers 3, a setup and conveying roller track being located at the lower edge of this wall, with several driven conveying rolls 4. The facility 1 is resting on the floor by way of feet 6, not shown in detail.

The apparatus 10 of this invention for closing openings in a spacer strip, not shown, of the insulating glass element 5 is located at the left-hand rim of the facility section 1, as seen in FIG. 1. The apparatus 10 comprises a nozzle 11 attached by way of a holding plate 12 to a support 13. The support 13 is connected, in turn, via rods 40 to the housing of a pressure medium cylinder 14. Additionally, the holder 16 of the pressure medium motor 14 can be swung about an essentially perpendicular axis 17; for this purpose, the end of the pressure medium cylinder 14 lying in opposition to the nozzle 11 is connected to a further pressure medium motor 18. In parallel to the pressure medium motor 18, a damping member 41 is arranged which brakes the pivoting movement during the outward moving of the nozzle 11. By pivoting the pressure medium motor 14 under the action of the pressure medium motor 18, the nozzle 11 can be moved to and fro in the direction of double arrow 19, i.e. approximately in the conveying plane or the plane of the insulating glass element 5.

The carrier 16 is displaceably guided in the machine frame together with the bearing (axle 17) in the direction of the double arrow 15. Driving action is exerted, for example, by way of a spindle-nut arrangement located underneath the apparatus 10, and by way of a motor. Thus, the nozzle 11 can be moved forwards and backwards in the direction of double arrow 15, i.e. transversely to the plane of the support 2.

The pressure medium motor 14 acts on an optionally heated storage cylinder 20 for sealant. At the front end of the storage cylinder 20, a shutoff member is provided which can be opened and closed by a pressure medium motor 42 by way of a lever 43. As soon as the shutoff member is opened, a measuring piston 44 is shifted downwardly by a pressure medium motor 45 and the sealant flows from the nozzle 11 while the latter is moved out of the opening of the spacer strip.

As can be seen from FIG. 3, the nozzle 11 is equipped with an extension 21 introducible into the opening to be sealed in the spacer strip. Since the openings to be sealed normally involve the gap between the ends of a prefabricated, flexible spacer strip arranged between the glass sheets of insulating glass elements 5, the extension 21 ordinarily has a flat rectangular configuration.

As shown in FIGS. 1 and 2, an arrangement 30 for a freely rotatable roller 31 is provided in the zone of apparatus 10; this arrangement can be lifted, under the action of a pressure medium cylinder 32, from a position hidden underneath the rollers 4 of the setup and conveying roller track (FIG. 1) into a position raised with respect to the track. For this purpose, the freely rotatable roller 31 is mounted to a support 33 guided in a guide means 34 attached to the facility section 1. The piston rod 35 of the pressure medium cylinder 32 is connected to the lower part of the support 33.

The liftable, freely rotatable roller 31 serves for the correct alignment of the insulating glass element, comprising the spacer strip with an opening to be sealed, with respect to the nozzle 11. For this purpose, the insulating glass element is transported along the roller track 4 to such a point that its vertical edge that is at the rear as seen in the conveying direction is located downstream of the liftable roller 31. After raising of roller 31, the insulating glass element 5 is conveyed backwards along the roller track until it comes into contact with the roller 31.

The aforedescribed apparatus operates as follows:

An insulating glass element wherein the gap between the end of a spacer strip (swiggle strip) located therebetween has not as yet been sealed is conveyed into the position illustrated in FIG. 1 in the section 1 of the facility. In case, for forming the left-hand lower corner in FIG. 1, in spacer strip of the insulating glass element has been formed with the use of a device according to German Utility Model GM 87 01 101, then the gap between the two ends of the spacer strip is located in an exactly defined position with respect to height. At this level, i.e. oriented in opposition to the gap, the extension 21 of nozzle 11 is located. After the insulating glass element 5, as described above, has been correctly positioned with the aid of roller 31, and the apparatus 10 and thus the nozzle 11 have been advanced by the spindle-nut arrangement, the nozzle 11 and, respectively, its extension 21 is introduced, by operating the pressure medium cylinder 18, into the gap between the ends of the spacer strip, and feeding of sealing compound is commenced. During the extrusion of sealing compound from the nozzle orifice under the action of the measuring piston 44, the nozzle 11 and thus also its extension 21 are gradually pulled out of the gap; for this purpose, the pressure medium cylinder 18 is again activated.

After the extension 21 has been pulled out in its entirety from the gap, i.e. the opening in the spacer strip to be sealed, the feeding of sealing compound is stopped by closing the shutoff member operated by lever 43, and the nozzle 11 is again retracted into its readiness position located behind the conveying plane of the insulating glass elements 5.

I claim:

1. Apparatus (1) for closing openings in spacer strips arranged between the glass sheets of insulating glass elements (5), comprising a frame, a nozzle (11) with an orifice for the delivery of sealing compound, this nozzle being movably held on said frame of the apparatus (1), the nozzle (11) having an extension (21) for introduction into the opening to be sealed; and drive means (18) and said extension can be introduced, in the direction of its nozzle orifice into the opening to be sealed, and can again be pulled out of this opening during the dispensing of sealing compound through the nozzle into the opening.

2. Apparatus according to claim 1, further comprising a setup roller track (4) for insulating glass elements (5) and with a lateral support (2, 3) for the latter, the nozzle (11) being mounted on a holder (13, 40, 16) on the frame of the apparatus to be pivotable about an axis (17) essentially perpendicular to the direction of the nozzle orifice.

3. Apparatus according to claim 2, wherein the holder (13) of the nozzle (11) can be shifted forwards and backwards transversely to the plane of the support (2,3) for the insulating glass elements (5).

4. Apparatus according to one of claim 1, further comprising a freely rotatable roller (31) provided as a stop for the positioning of the insulating glass element (5) with respect to the nozzle (11), this roller being liftable from a position hidden underneath the roller track (4) into a position raised above this roller track.

5. Apparatus according to one of claim 1, wherein the nozzle (11) has a storage cylinder (20) for sealing compound, the sealing compound contained in the storage cylinder (20) being exposable to pressure.

6. Apparatus according to claim 5, further comprising a shutoff member and a measuring piston for sealing compound provided between said storage cylinder (20) for sealing compound and the nozzle (11).

7. Apparatus according to claim 1, wherein the structural unit of the nozzle (11), pressure medium motor (14), and nozzle mounting (13, 16, 40) is held in the machine frame to be displaceable transversely to the plane of the insulating glass elements (5).

8. Apparatus according to claim 7, wherein, for pivoting the structural unit, a pressure medium motor (18) is provided, and a shock absorber (41) for braking the movement of the structural unit during the outward movement of the nozzle (11) from the opening to be sealed.

* * * * *

UNITED STATES PATENT AND TRADEMARK OFFICE

CERTIFICATE OF CORRECTION

PATENT NO. : 4,902,213

DATED : February 20, 1990

INVENTOR(S) : Peter LISEC

It is certified that error appears in the above—identified patent and that said Letters Patent is hereby corrected as shown below:

IN THE CLAIMS:

Claim 1, line 7, after "drive means (18)" insert --by which the nozzle (11)--.

Signed and Sealed this

Eighth Day of January, 1991

*Attest:*

*Attesting Officer*

HARRY F. MANBECK, JR.

*Commissioner of Patents and Trademarks*